United States Patent [19]

Ramsey

[11] 4,403,668

[45] Sep. 13, 1983

[54] STABILIZING DRILL COLLAR

[76] Inventor: Rickey H. Ramsey, Rte. 1, Palacios, Tex. 77465

[21] Appl. No.: 328,118

[22] Filed: Dec. 7, 1981

[51] Int. Cl.[3] ..... E21B 17/10

[52] U.S. Cl. ..... 175/325; 308/4 A

[58] Field of Search ..... 166/241; 175/320, 325, 175/406, 407; 308/4 A

[56] References Cited

U.S. PATENT DOCUMENTS

| | | | |
|---|---|---|---|
| 2,033,638 | 3/1936 | Kappl | 308/4 A |
| 3,250,578 | 5/1966 | Lubbes | 308/4 A |
| 3,268,274 | 8/1966 | Ortloff et al. | 308/4 A |

*Primary Examiner*—James A. Leppink
*Assistant Examiner*—Joseph Falk
*Attorney, Agent, or Firm*—Pravel, Gambrell, Hewitt, Kirk & Kimball

[57] ABSTRACT

A stabilizing drill collar having eight longitudinally-extending sides with means for connecting the collar in a drill string, and having a plurality of wear members welded to alternating sides of the collar. The area of the collar affected by the heat of welding the wear members to the collar is outside the effective circumference of the collar, with the circumference being measured from opposite, flat surfaces of the sides of the collar.

10 Claims, 4 Drawing Figures

STABILIZING DRILL COLLAR

BACKGROUND OF THE INVENTION

1. Field of the Invention

The invention relates to a stabilizing drill collar. More particularly, the drill collar of the invention is preferably octagon shaped with wear members attached to at least four, opposing sides thereof to improve exterior circulation and contact with the wall of the hole.

2. Prior Art

Stabilizing drill collars are often referred to as "square" drill collars and generally relate to essentially long length stabilizers, connectable in a drill string, used to control the rate of angle change of hole angle deviation from a desired drilling course. Use of square drill collars usually results in a smooth, gradual direction change in the hole which acts to simplify the drilling operation by preventing problems due to dog-legs, high angle deviation and reduced penetration rates. The overall effect is to produce a more usable hole at a reduced cost.

This is accomplished by a combination of drill collar body stiffness and support of the collar, by the wall of the hole, over the long wall contact length of the collar. Most square drill collars, or their facsimilies have some common, basic likenesses. All have rotary shouldered connections on each end of the collar for connecting the collar to other drill string members. All have an internal fluid flow passage extending longitudinally through the collar for drilling fluid circulation. All have designs permitting exterior fluid circulation. All have some design of hard metal, wear resistant surfaces to contact the hole wall.

A somewhat typical square drill collar is manufactured by Reamco, Inc. of Lafayette, Louisiana and is illustrated in the *Composite Catalog of Oil Field Equipment & Services,* 1976–77, Gulf Publishing Company, Houston, Texas, p. 4639. The Reamco "Square" drill collar is manufactured from typical steel round bar stock. The collar is termed "square" due to its appearance after ribs are welded longitudinally along its sides.

In some instances, the collar is manufactured from square steel billets that are bored for internal circulation of drilling fluids. However, the square billet type of drill collar does not provide for replaceable wear members forcing its total loss when worn to a point where it is the wrong size.

However, the basic bar stock for manufacturing drill collars is usually round. The wear members are welded onto the round bar stack to provide a replaceable wear surface that contacts the wall of the hole being drilled. Even though the finished drill collar is relieved of stress by heat treatment it has been found that welding along the length of the bar stock alters the strength characteristics of the bar stock in the vicinity of the weld. This often leads to weakening of the welded section and irreparable damage to the drill collar.

Drilco, a division of Smith International, Inc. has attempted to avoid this problem by providing an essentially round drill collar, having increased diameter sections at each end thereof and at the mid-section. These increased diameter sections are machined to receive wear pads having tungsten-carbide pressed-fit buttons, with the pads bolted in place to avoid creating a heat affected area in the collar.

All of the prior art stabilizing drill collars suffer from excessive flexibility, damage from heat affected zones and/or limited wall contact-wall support.

A primary objective of the invention is to provide a stabilizing drill collar having replaceable wear members that are welded on the collar without producing a heat affected zone that lies within the effective diameter of the drill collar.

Another objective of the invention is to provide an eight sided stabilizing drill collar having mounted upon at least four sides thereof replaceable wear members welded thereon, with the weld induced heat affected zone maintained virtually completely from the effective diameter of the drill pipe, with the drill collar having improved rigidity and wall contact.

Another objective of the invention is to provide a stabilizing drill collar having an improved exterior fluid circulation path when mounted on a drill string and placed in a well.

DESCRIPTION OF THE DRAWINGS

For a more complete understanding of the present invention reference is made to the following description in conjunction with the accompanying drawing in which.

DESCRIPTION OF THE PREFERRED EMBODIMENTS

Figure 1:
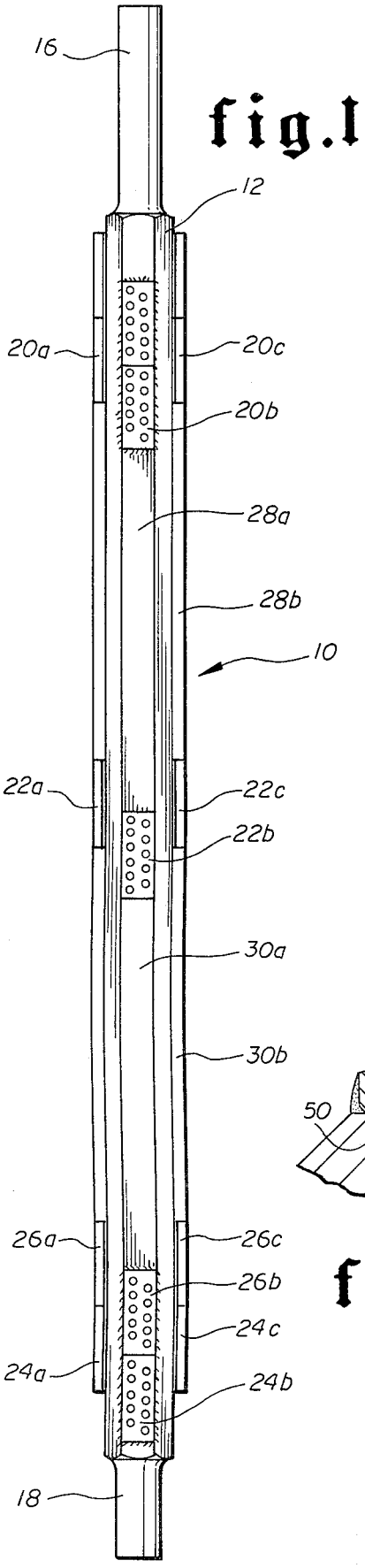
FIG. 1 is a plane view of one embodiment of the stabilizing drill collar of the invention illustrating placement of the wear members.

In the drawing numeral 10 designates the stabilizing drill collar of the present invention. Referring to FIG. 1, there is illustrated one embodiment of the stabilizing drill collar 10 of the invention, which comprises an elongated body having eight essentially flat sides 12 extending longitudinally along the length thereof, and having a longitudinal internal flow path 14, as shown in FIG. 2, extending therethrough.

The body is preferably manufactured from bar stock normally used in the industry for manufacturing drill collars. This is generally mill rolled or mill formed from 4145, 4145H or 4340 steel, to provide better weldability. However, similar steel may be used successfully. A portion of each end 16 and 18 of the body is milled to provide an essentially round, threadable portion to allow connection of the drill collar 10 to other pieces of the drill string.

Figure 2:
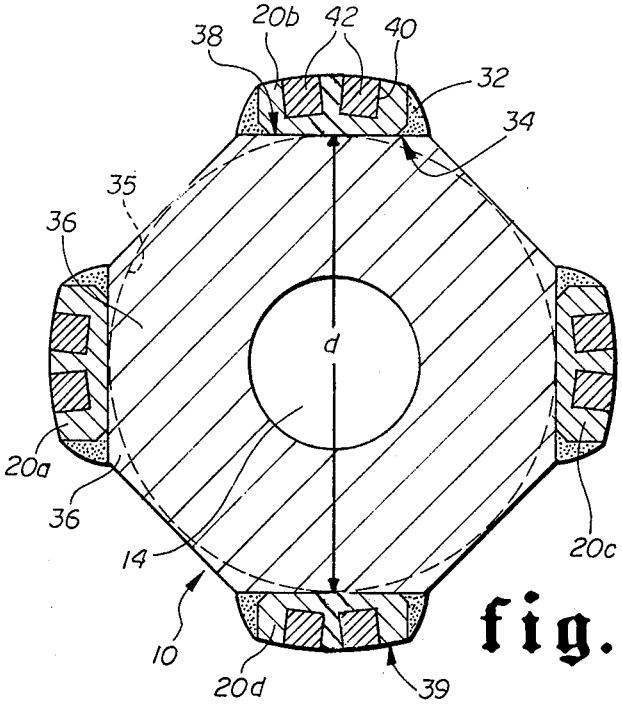
FIG. 2 is a cross-sectional view of the stabilizing drill collar of the invention, taken along the line 2—2 of FIG. 1, illustrating the placement of the wear members with respect to the heat affected zone and the effective diameter of the collar.

Referring to FIGS. 1 and 2, it will be seen that on at least four of the essentially flat surfaces 12 of the drill collar there is affixed a plurality of wear members 20, 22, 24 and 26. The wear members are arranged so that they are positioned generally toward each end 16 and 18 of the drill collar 10, as well as, in essentially the middle thereof.

In a preferred embodiment of the invention, the wear members would be grouped as a set, such as the wear members 24 and 26 on the lower end of the drill collars illustrated in FIG. 1. There is shown two wear members 24a and 26a on a single side of the collar 10, with corresponding sets 24b, 26b and 24c, 26c on alternate surfaces. A fourth set (not shown) would be on the alternate face not shown in FIG. 1, but as illustrated in FIG. 2.

While two wear members 24 and 26 are shown, it would be acceptable to have either only one or several wear members in a set. It has been found, however, that two wear members in each set is the preferred configuration for optimum wear characteristics and to provide sufficient stabilization of the collar 10 in the well.

A single wear member 22a, 22b and 22c is preferably positioned at about the middle of the drill collar 10. However, if desired, more than one can be used. The single wear member, on each alternate collar face, provides contact with the wall of the hole in the event of any bending of the collar 10.

While FIG. 1 shows the wear members 20, 22 and 24 offset in alternate rows, this is not necessary to achieve optimum benefit of the drill collar 10 of the invention. As a practical matter, the wear members can be arranged to coincide circumferentially about the drill collar 10. It is preferred that rib members 28 and 30 be connected to the flat sides of the collar to connect the sets of wear members 20, 22 and 26. It is preferred that the rib members be essentially the same length and width as the wear members so that when they are all lined up and connected to a face of the collar 10, there appears to be a continuous, single metal strip connected to the face. This arrangement provides maximum protection to both the rib members and the wear members.

It is preferred that the rib members and the wear members be welded to the drill collar 10. Referring to FIG. 2, there is illustrated the weld bead 32 covering the area 34 of the flat surface not covered by the wear member 20b. In fact, the wear member 20b should be of a width, in relation to the width of the flat collar surface 38, to allow sufficient area for the weld bead 32.

Figure 4:
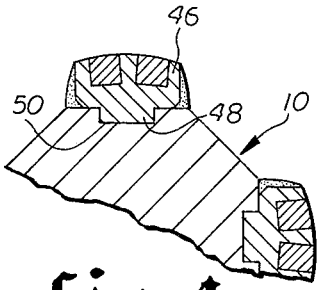
FIG. 4 is partial, sectional view of the stabilizing drill collar, as shown in FIG. 2, illustrating an alternate configuration of the wear member.

It should be noted that the wear members 46 may be shaped to have a key section 48 projecting from the bottom portion of the wear member 46. Referring to FIG. 4, it can be seen that the body face 12 of the drill collar 10 would then have a groove 50 for receiving the keyed wear member 46. This configuration of the drill collar 10 provides added resistance to shear forces acting against the wear member 46 and prolongs the life of the drill collar 10.

The effective diameter d of the collar 10 is measured between the middle of opposing flat sides of the collar. The dotted circle represents the circumference 35 of the collar 10 having an effective diameter d. This leaves an area of metal 36 which lies outside the circumference 35, which is exposed to the weld heat. It has been found that the heat affected zone 36 is not subjected to the bending stresses of the remainder of the collar, leading to greatly extended life of the drill collar of the invention.

Figure 3:
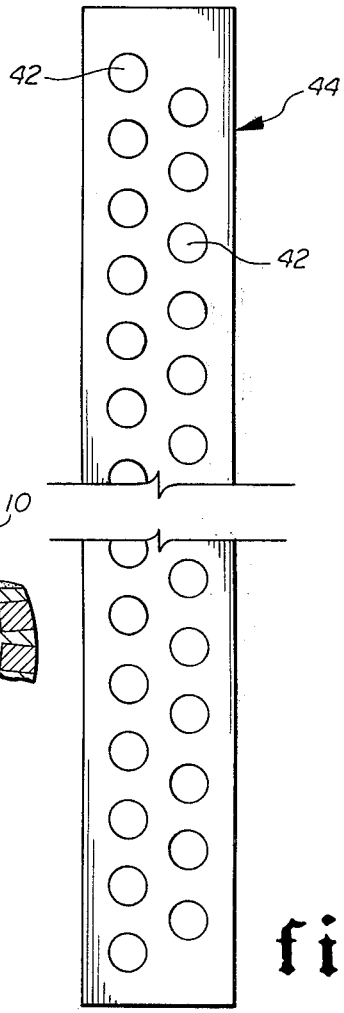
FIG. 3 is a plane view of a portion of a wear member useful in the present invention.

It is preferred that the outer surface 39 of the wear members be somewhat curved. This reduces breakage and excessive, uneven wear of the wear member when the collar 10 is rotated in the well. Also, it is preferred that the wear members 44 be either faced with a hard metal coating or have hard metal tabs 42 inserted therein. Referring to FIG. 3, there is illustrated a typical wear member 44 having hard metal tabs 42 installed in suitable receptacles machined in the outside face thereof.

This can be seen, particularly in the cross-sectional view of FIG. 2. The tabs 42 are press fitted into a receptacle 40 machined in the wear member 20b. The tabs 42 may be tungsten carbide or any other suitable "hard metal" material useful in the drilling industry. As used in the present invention, it is preferred that the tabs 42 be installed so that they are flush with the outer surface 39 of the wear member 20.

What is claimed is:

1. A stabilizing drill collar connectable in a drill string comprising:

an elongated body having eight flat sides of substantially the same width extending longitudinally along the length thereof, with pairs of sides being diametrically opposite, and having a longitudinal internal flow passage extending therethrough;

the elongated body having an effective diameter measured between the middle of opposing flat sides of said elongated body;

a plurality of wear members welded to at least four alternating sides of said eight sides and extending longitudinally along at least a portion of said sides;

a plurality of longitudinally extending rib members connecting said wear members along each side containing said wear members, whereby there is a longitudinally continuous combination of wear members and rib members; and said wear members being welded to said sides on portions outside said effective diameter wherein the area of said collar affected by the heat of welding said wear members thereto is outside said diameter of said elongated body.

2. The stabilizing drill collar of claim 1, including means for connecting said drill collar in a string of drilling members with a drill bit and wherein said longitudinal internal flow passage is of sufficient size to allow passage therethrough of fluids.

3. The stabilizing drill collar of claim 2, wherein said eight sides are essentially equal in width and extend longitudinally along said body with only a portion on each end of said body being round to provide means for connecting said drill collars in said string.

4. The stabilizing drill collar of claim 1, wherein each of said plurality of wear members is replaceable.

5. The stabilizing drill collar of claim 1, wherein the wear members welded to the drill collar are shaped to have an essentially flat bottom surface in contact with a side of said drill collar.

6. A stabilizing drill collar connectable in a drill string comprising:

an elongated body having eight flat sides of substantially the same width extending longitudinally along the length thereof, with pairs of sides being diametrially opposite, and having a longitudinal internal flow passage extending therethrough;

the elongated body having an effective diameter measured between the middle of opposing flat sides of said elongated body;

a plurality of sets of wear members welded to at least four alternating sides of said eight sides and extending longitudinally along a major portion of each of said alternating sides, and wherein a set of said wear members is positioned to terminate at essentially each end of said drill collar, with each set of wear members comprising at least four wear members welded on each of said alternating sides, said wear members being connected by rib members which are welded to said sides; and said wear members and said rib members being welded to said sides on portions outside said effective diameter wherein the area of said drill collar affected by the heat of welding said wear members and rib members thereto is outside said effective diameter of said elongated body.

7. The stabilizing drill collar of claim 6, wherein there are eight wear members in each set, with two wear members of each set positioned on alternating sides of said drill collar.

8. The stabilizing drill collar of claim 6, wherein there is welded to said drill collar a set of wear members positioned at essentially the middle thereof.

9. The stabilizing drill collar of claim 6, wherein the wear members welded to the drill collar are shaped to have an essentially flat bottom surface in contact with a side of said drill collar.

10. The stabilizing drill collar of claim 6, wherein the wear members welded to the drill collar are shaped to have a portion of the bottom surface thereof extending vertically therefrom with said extending portion being received and positioned in a matching cavity formed in the surface of said drill collar.

* * * * *